United States Patent [19]

Szabo

[11] 4,019,661

[45] Apr. 26, 1977

[54] LIQUID DISPENSER FOR SELECTIVE UPSIDE DOWN OR RIGHT SIDE UP USE

[76] Inventor: Janos Szabo, 214 E. 82nd St., New York, N.Y. 10028

[22] Filed: July 17, 1975

[21] Appl. No.: 596,730

[52] U.S. Cl. ..... 222/376

[51] Int. Cl.[2] ..... B67D 5/40

[58] Field of Search ..... 222/321, 382, 385, 383, 222/376, 402.17, 402.18, 402.19; 239/333

[56] References Cited

UNITED STATES PATENTS

| | | | |
|---|---|---|---|
| 2,556,180 | 6/1951 | Hamilton et al. | 222/382 X |
| 2,792,974 | 5/1957 | LaVern et al. | 222/376 |

FOREIGN PATENTS OR APPLICATIONS

| | | | |
|---|---|---|---|
| 245,734 | 10/1925 | United Kingdom | 222/402.19 |

*Primary Examiner*—Stanley H. Tollberg
*Assistant Examiner*—Norman L. Stack, Jr.
*Attorney, Agent, or Firm*—Jack D. Slobod

[57] ABSTRACT

A liquid dispenser includes a nozzle and pump assembly mounted on a cap for a container. A straight suction tube below the cap leading from the nozzle and pump assembly to the bottom of the container is perforated just below the cap and an attachment which is a short length of tube is carried about the suction tube in a manner where it may be slid sealably over the perforations to permit fluid to be sucked from the bottom of the container. For dispensing or spraying liquid with the container upside down, the perforations are left uncovered, and the end of the tube at the bottom of the container is sealed with a removeable end cap attachment. To enable the last of the liquid in the container to be dispensed a removeable 90° elbow attachment is provided fitted on the bottom end of the tube.

1 Claim, 4 Drawing Figures

Fig. 1
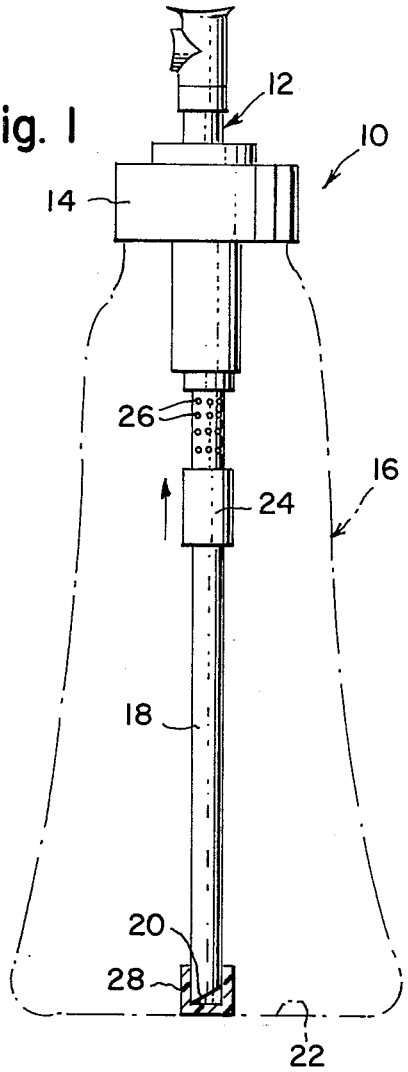
Fig. 2
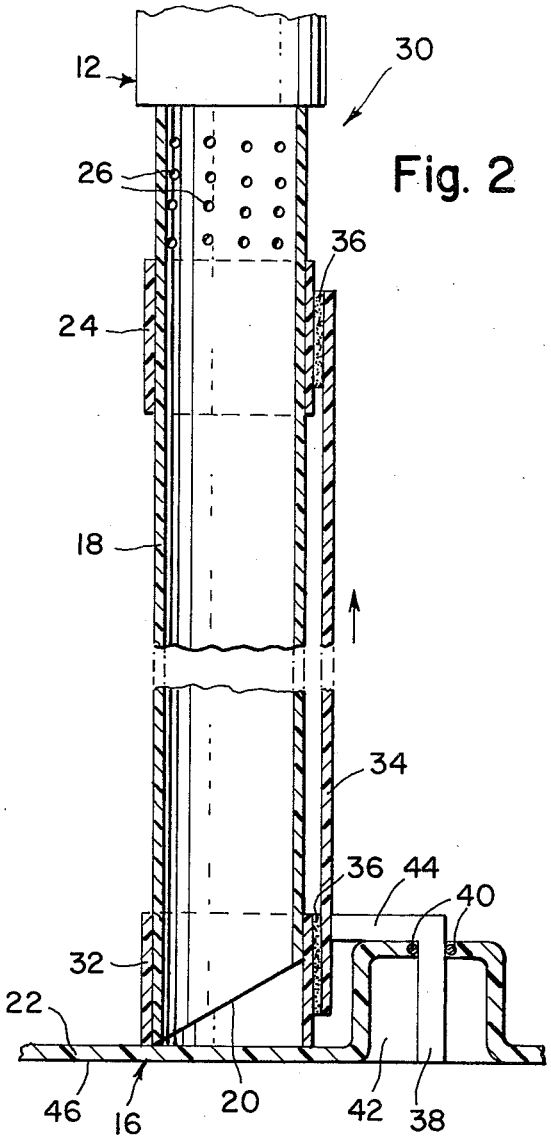
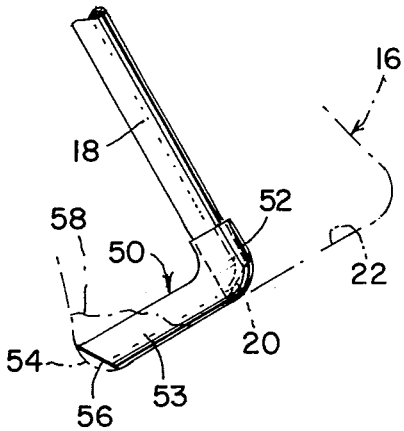
Fig. 3
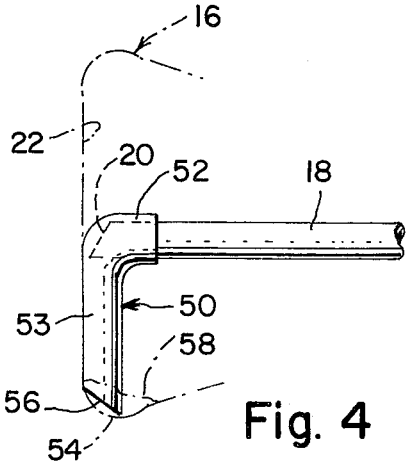
Fig. 4

LIQUID DISPENSER FOR SELECTIVE UPSIDE DOWN OR RIGHT SIDE UP USE

FIELD OF THE INVENTION

The present invention relates generally to devices for dispensing or spraying liquid from a container. In its particular aspects, the present invention relates to the provision of separate sealable aperture means at the bottom and top of the container to allow liquid to be dispensed irrespective of the orientation of the container.

BACKGROUND OF THE INVENTION

In the use of liquid cleaning fluid preparations which are sprayed from a non-pressurized bottle container by a cap mounted pump and nozzle assembly, it is often necessary to angulate the container to spray fluid onto hard to reach places. Since the pump and nozzle assembly is coupled to a suction tube within the container which has an open end at the bottom of the container, ordinarily no fluid is dispensed when the container is substantially inverted. Yet it is realized that it is necessary for the suction tube to terminate at the bottom of the container in order to dispense most of the liquid therein.

Another problem with such prior art liquid dispensers is that there is generally a residue of liquid left in the container which cannot effectively be dispensed, which residue is wasted. While it is known that if the suction tube is bent so that the open end lies at the bottom corner of the container, such as in U.S. Pat. No. 3,120,906 to Harnage, the last drop of liquid can be effectively dispensed, most manufacturers provide straight suction tubes which terminate at the center of the bottom wall of the container. There is a need for an attachment for straight suction tubes to enable the last drop of liquid to be dispensed.

OBJECTS OF THE INVENTION

It is an object of the present invention to provide a cap mounted liquid dispenser for a container which is capable of dispensing liquid when the container is oriented upside down.

It is a further object of the present invention to provide a liquid dispenser capable of dispensing upside down, which may be arrived at with simple modifications of common dispensers so that the housewife may make these modifications.

It is yet another object of the present invention to provide an attachment for dispensers having straight suction tubes to enable the last drop of liquid to be dispensed.

SUMMARY OF THE INVENTION

Briefly, the aforementioned and other objects of the present invention are satisfied to providing a liquid dispenser having perforations on the top end of the suction tube which leads from a cap mounted pump and nozzle for drawing in liquid just below the cap to enable the dispenser to be utilized in an upside down orientation. To permit normal upright use of the dispenser, a tubular member is positioned about the suction tube so that it may be slid sealably over the perforations, allowing liquid to be drawn into the open end of the suction tube from the bottom of a container.

When the tubular member is positioned to uncover the perforations, a cap attachment is provided to seal the open end of the tube.

In an alternate embodiment, a tubular cap and the tubular member are coupled by a connecting rod actuated by a button passing through the container to avoid having to unscrew the pump and nozzle to switch spraying modes.

For enabling the last drop of liquid in a container to be dispensed, a ninety degree elbow attachment is provided. The attachment has one end fitted on the open end of the suction tube and another end terminating at a bottom corner of the container.

Other objects, features, and advantages of the present invention will become apparent upon perusal of the following detailed description of the preferred embodiments thereof when taken in conjunction with the appended drawing wherein:

FIG. 1 is an elevational view of the liquid dispenser of the present invention.

FIG. 2 is an elevation cross-sectional enlargement of a portion of the liquid dispenser similar to FIG. 1, but except of an alternate embodiment.

FIGS. 3 and 4 are views of the bottom of the dispenser of FIG. 1 but depicted as utilized in an alternate mode.

DETAILED DESCRIPTION

Referring to FIG. 1, there is illustrated the liquid dispenser 10 of the present invention which comprises a conventional pump and nozzle assembly 12 mounted centrally through a screw-on cap 14, engaged on an elongated tapered bottle or container 16 for a liquid such as a cleaning preparation. As further is usual a straight suction tube 18 is received in nozzle and pump assembly 12 below cap 14. Tube 18 projects to an open tapered end 20 which lies close to the center of the bottom wall or base 22 of container 16 for drawing in liquid from the bottom of container 16 to be dispensed via pump and nozzle assembly 12, when the container is in a substantially upright position.

As distinguished from the prior art a short length of resilient tubing 24, as of plastic, having an inside diameter equal to the outside diameter of suction tube 18 is fitted slideably over the suction tube. As further distinguished from the prior art, the top end of suction tube 18 is provided with plural holes or apertures 26 in the tube wall just below pump and nozzle assembly 12 to enable liquid to be drawn into the pump and nozzle assembly from just below cap 14. Thus with the container 16 inverted or upside down so that the open end 20 is above the fluid level, it is still possible to dispense liquid which is drawn in through perforations on holes 26. To accomplish this, a removeable end cap 28 is provided to sealably fit on the open end 20, to prevent air from being drawn therethrough.

Now, it should be apparent that the dispenser 10 of the present invention may be utilized in two modes. In a first mode adapted for upright dispensing, the tube 24 is slid by hand in position over perforations 26 to sealably cover the perforation allowing liquid to be drawn from open end 20, the end cap 28 not being used. In a second mode, adapted for dispensing when the bottle 16 is inverted or upside down, the tube 24 is slid downward to uncover holes 26 and the open end 20 is sealed with end cap 28.

It should also be understood that the suction tube 18 is easily removed from bottle 16 by unscrewing cap 14 to make the aforementioned mode switching adjustments.

In FIG. 2 there is illustrated an alternate embodiment dispensing system 30 which includes many of the features of the dispensing system 10 of FIG. 1, but avoids the necessity of having to unscrew cap 14 in order to slide tube piece 24 and put on or remove end cap 28. In the dispenser 30, an alternate end cap 32 is utilized for open end 20 which is essentially a short length of tube similar to tube 24. Cap 32 functions by resting its open bottom end sealably on top of surface 22 to seal close off the open end 20 of suction tube 18. It should also be noted that tubular end cap 32 could be used in the embodiment depicted in FIG. 1. The cap 32, when it is slid upwards along suction tube 18, uncovers the tapered open end 20 to permit the entrance of liquid into the suction tube.

Further there is provided a connecting rod 34 directed along the side of suction tube 18. Connecting rod 34 at its top end is secured to tubular member 24 and at its bottom end is secured to tubular cap 32 via adhesive layers 36. The provision of connecting rod 34 requires that the tubular member 24 and tubular cap 32 slide up or down along suction tube 18 in unison. Thus when tubular member 24 covers apertures 26, tubular cap uncovers open end 20 and vice versa.

For vertically moving connecting rod 34, the rod is secured to a push button 38 which projects downwardly through a seal 40 in a finger well 42 formed in the bottom wall 22 of container 16. The push button 38, which is secured to rod 34 by a horizontal leg 44 between the push button and the rod, is provided of a length approximately equal to the depth of the finger well 22 so that when the leg 44 rests on top of finger well 42, the button does not project beyond the underside 46 of the container 22.

In the position, where leg 44 rests on top of finger well 42, the tubular cap 32 rests on the bottom surface 22 of container 16 covering open end 20, and the tubular member is below apertures 26 enabling upside down dispensing. To enable dispensing of liquid when the container 16 is in a substantially upright orientation, button 38 is pushed, by inserting a finger in well 42. As a consequence, the tubular member 24 and tubular cap 32 are slid upwards in unison to respectively cover apertures 26 and uncover open end 20.

Now referring to FIGS. 3 and 4, in recognition of the fact that the suction tube 18 is not configured to draw up all of the liquid in the bottle 16, a ninety degree tubular elbow attachment 50 for the open end 20 of the suction tube is provided. Elbow 50 has one leg 52 adapted to sealably receive the open end 20 and another leg 53 joined thereto which lies on bottom wall 22 and projects to a bottom corner 54 of the bottle 16 and terminates there with a tapered open end 56. As illustrated in FIGS. 3 and 4, as the bottle 16 is angulated in a variety of positions, the last of the liquid 58 in container 16 collects in corner 54 provided that corner is maintained lowest.

Having described the preferred embodiments of the invention in detail it should be apparent that numerous modifications, additions, and omissions in the details thereof are possible within the intended spirt and scope of the invention. Accordingly, the following claims define the scope of the invention.

What is claimed is:

1. A liquid dispenser for a container for dispensing liquid in a first mode when said container is upright and in a second mode when said container is upside down, said dispenser comprising: removeable cap means for the top of said container; pump and nozzle means mounted through said cap means; a suction tube within said container coupled to said pump and nozzle means and extending downward towards the bottom of said container; a first fluid intake opening in said tube proximate the top of said container; first sealing means slideably mounted on said tube proximate said first intake opening, said first sealing means being positionable in an upper position for covering said first intake opening and in a lower position for uncovering said first intake opening; a second fluid intake opening formed in said tube proximate the bottom of said container; second sealing means slideably mounted on said tube proximate said second intake opening; said second sealing means being positionable in an upper position for uncovering said second intake opening and in a lower position for covering said second intake opening; linkage means extending between and attached to said first and second sealing means for linking said first and second sealing means for movement as a unit; and control means coupled to said linkage means and extending through a wall of said container for enabling manual application of a force for moving said unit.

* * * * *